US012779357B2

(12) United States Patent
Zhou

(10) Patent No.: US 12,779,357 B2
(45) **Date of Patent: *Nov. 3, 2026**

(54) INFLATABLE COSTUME

(71) Applicant: Shenzhen Xinbenchuang Electronics Co., Ltd., Shenzhen (CN)

(72) Inventor: Zanzan Zhou, Shenzhen (CN)

(73) Assignee: Shenzhen Xinbenchuang Electronics Co., Ltd., Shenzhen (CN)

( * ) Notice: Subject to any disclaimer, the term of this patent is extended or adjusted under 35 U.S.C. 154(b) by 235 days.

This patent is subject to a terminal disclaimer.

(21) Appl. No.: 18/581,292

(22) Filed: Feb. 19, 2024

(65) Prior Publication Data

US 2024/0189735 A1 Jun. 13, 2024

Related U.S. Application Data

(63) Continuation-in-part of application No. 17/833,865, filed on Jun. 6, 2022, now abandoned.

(30) Foreign Application Priority Data

Feb. 1, 2024 (CN) ..... 202420251565.6

(51) Int. Cl.
*A63J 7/00* (2006.01)
*A41D 1/00* (2018.01)

(52) U.S. Cl.
CPC ..... *A63J 7/005* (2013.01); *A41D 1/00* (2013.01)

(58) Field of Classification Search
CPC .... A01K 13/006; A41D 13/012; A41D 13/02; A41D 15/00; A41D 2400/14; A63H 33/00; A63J 7/005
See application file for complete search history.

(56) References Cited

U.S. PATENT DOCUMENTS 492,643 A * 2/1893 Van Oostrum ..... A41D 13/012 2/232
693,996 A * 2/1902 Brand ..... B63C 9/1055 441/104
1,640,270 A * 8/1927 Russell ..... B64D 10/00 128/DIG. 20
3,382,504 A * 5/1968 Barbosa ..... A41D 1/00 D2/741
4,023,223 A * 5/1977 Anderson ..... A41D 13/0125 441/104

(Continued)

*Primary Examiner* — Michael D Dennis
*Assistant Examiner* — Matthew B Stanczak

(57) ABSTRACT

An inflatable costume includes a main body and a tightening device. The main body includes a head part and a body part. The tightening device is arranged between the head part and the body part. Through the above structure, when a user wears the inflatable costume, the inflatable costume can be tightened and fixed at the neck of shoulders of the user by the tightening device arranged between the head part and the body part. Furthermore, the tightening device can be adjusted according to sizes of the neck and shoulders of the user, thereby preventing the following phenomena: The inflatable costume will be loosened when the user wears it, the head part of the inflatable costume will drop, or the inflatable costume will easily move in aggravating activities, so that the inflatable costume has higher stability and applicability, and the user experience is greatly improved.

18 Claims, 4 Drawing Sheets

(56) References Cited

U.S. PATENT DOCUMENTS 4,498,199 A * 2/1985 Margolis ..... A63H 3/003 446/28
5,003,630 A * 4/1991 Bassick ..... B64G 6/00 2/2.11
5,467,543 A * 11/1995 Fink ..... A63H 3/06 446/178
5,564,963 A * 10/1996 Chan ..... A63H 23/00 446/179
6,292,947 B1 * 9/2001 Bechis ..... A41D 7/00 2/67
6,357,049 B1 * 3/2002 Hoffman ..... G09F 21/026 2/206
6,644,843 B2 * 11/2003 Chin-Cheng ..... A63H 27/10 446/226
6,708,927 B2 * 3/2004 Chen ..... B64D 17/00 182/230
6,922,848 B1 * 8/2005 Stanley ..... A41D 1/00 2/244
7,343,632 B2 * 3/2008 Neron ..... A62B 99/00 2/456
11,944,133 B2 * 4/2024 Musser ..... A41D 13/0025
12,115,464 B2 * 10/2024 Zhou ..... A63J 7/005
D1,068,213 S * 4/2025 Zhou ..... D2/741
D1,078,222 S * 6/2025 Luo ..... D2/741
D1,083,299 S * 7/2025 Zhou ..... D2/741
D1,088,410 S * 8/2025 Zhou ..... D2/741
D1,089,957 S * 8/2025 Gu ..... D2/741
D1,096,072 S * 10/2025 Wu ..... D2/741
D1,096,073 S * 10/2025 Chen ..... D2/741
D1,101,354 S * 11/2025 Deng ..... D2/741
D1,102,092 S * 11/2025 Xu ..... D2/741
D1,102,715 S * 11/2025 Zhou ..... D2/741
D1,107,824 S * 12/2025 Zhou ..... D21/612
D1,114,461 S * 2/2026 Zhao ..... D2/741
D1,124,586 S * 5/2026 Ji ..... D2/741
D1,130,958 S * 6/2026 Zhou ..... D2/741
2003/0040252 A1 * 2/2003 Stanier ..... A63J 5/00 446/220
2003/0182705 A1 * 10/2003 Spongberg ..... A41D 1/00 2/69
2005/0159072 A1 * 7/2005 Brown ..... A41D 1/002 446/26
2006/0048291 A1 * 3/2006 Sims ..... A41D 13/02 2/456
2008/0318490 A1 * 12/2008 Hsu ..... F04D 29/00 446/178
2011/0016601 A1 * 1/2011 Berman ..... A41D 1/00 2/69
2013/0152270 A1 * 6/2013 Neal ..... A41D 3/005 2/84
2020/0154671 A1 * 5/2020 Chen ..... A01K 13/00
2022/0312861 A1 * 10/2022 Ayoubi ..... A41D 31/10
2024/0165532 A1 * 5/2024 Zhou ..... A63J 7/005
2024/0189735 A1 * 6/2024 Zhou ..... A41D 1/00
2024/0252938 A1 * 8/2024 Al-Delaimy ..... A63H 3/28
2025/0249370 A1 * 8/2025 Zhou ..... A41D 1/00
2025/0387719 A1 * 12/2025 Zhou ..... A63H 3/06

* cited by examiner

INFLATABLE COSTUME

CROSS-REFERENCE TO RELATED APPLICATIONS

The application claims priority of Chinese patent application CN202420251565.6, filed on Feb. 1, 2024, which is incorporated herein by reference in its entireties.

TECHNICAL FIELD

The present disclosure relates to the field of inflatable costumes, and in particular, to an inflatable costume.

BACKGROUND

In today's entertainment culture, the rise of festival celebrations and theme activities provides a unique stage for the application of inflatable doll costumes. For example, Halloween attracts thousands of children and adults to participate in the celebration in various creative looks. In this happy festival, inflatable doll costumes have become one of the favorite outfits for children due to their exaggerated and funny appearances.

However, with the continuous pursuit of the use experience, the existing inflatable costumes have certain inconvenience. For example, if a user puts on the inflatable costume, because the inflatable costume is oversize relative to a human body, the inflatable costume will be loosened when a user wears it, the head part of the inflatable costume will drop, or the inflatable costume will easily move when a user walks around.

To this end, the present disclosure provides an inflatable costume to improve the applicability and user experience of the inflatable costume.

SUMMARY

In order to overcome the shortcomings of the prior art, the present disclosure provides an inflatable costume to improve the applicability and user experience of the inflatable costume.

The technical solution adopted by the present disclosure to solve the technical problem is as follows.

The present disclosure provides an inflatable costume, including:

- a main body, wherein the main body includes a head part and a body part; and
- a tightening device, wherein the tightening device is arranged between the head part and the body part.

As the improvement of the present disclosure, the head part has a first inflation chamber; the body part has a second inflation chamber; the first inflation chamber is communicated to the second inflation chamber; and the tightening device is arranged between first inflation chamber and the second inflation chamber.

As the improvement of the present disclosure, the tightening device includes a barrier layer connected to the main body; the barrier layer has a first opening; and the first inflation chamber, the first opening, and the second inflation chamber are communicated to each other in sequence.

As the improvement of the present disclosure, the barrier layer is provided with a first elastic band; and the first elastic band is configured to adjust a size of the first opening.

As the improvement of the present disclosure, the barrier layer is provided with a first flexible sleeve at a position close to the first opening, and the first elastic band is at least partially located inside the first flexible sleeve.

As the improvement of the present disclosure, an elastic strainer is also arranged on the first elastic band; when the elastic strainer is pressed, a length of the first elastic band located inside the first flexible sleeve is adjusted; and when the elastic strainer is released, the first elastic band is fixed to compress the first flexible sleeve.

As the improvement of the present disclosure, the barrier layer further has at least one air hole; and the first inflation chamber, the air hole, and the second inflation chamber are communicated to each other in sequence.

As the improvement of the present disclosure, the air hole is arranged around the first opening.

As the improvement of the present disclosure, the inflatable costume further includes an air blasting component, wherein the air blasting component is detachably connected to the main body; and the air blasting component is configured to inflate the head part and the body part to fill the first inflation chamber and the second inflation chamber with air.

As the improvement of the present disclosure, the air blasting component includes an air blasting housing; the air blasting housing has an air inlet mesh, an air guide chamber, and an air outlet; the air inlet mesh, the air guide chamber, and the air outlet are communicated to each other in sequence; a motor and a wind wheel are arranged in the air guide chamber; the wind wheel is mounted on an output shaft of the motor; and the air inlet mesh is coaxial with the motor.

As the improvement of the present disclosure, the air blasting component further includes a mesh pressing component; the mesh pressing component is annularly arranged on an outer side of the air inlet mesh; the main body is provided with a mounting port adapting to be assembled with the mesh pressing component; and the mesh pressing component is configured to assemble and connect the air blasting component with the main body.

As the improvement of the present disclosure, the mesh pressing component includes a rotary ring for mesh pressing and a fixed ring; the rotary ring for mesh pressing is detachably screwed onto the fixed ring; and the fixed ring is fixedly arranged at a periphery of the air inlet mesh.

As the improvement of the present disclosure, the inflatable costume further includes a charging component, wherein the charging component is electrically connected to the air blasting component; and the charging component is configured to supply power to the air blasting component.

As the improvement of the present disclosure, the main body is connected to a storage bag; the storage bag is located in the second inflation chamber; the storage bag has a storage chamber and a storage opening; the storage opening is communicated to the storage chamber; and the storage chamber is configured to place the charging component.

As the improvement of the present disclosure, the charging component includes a charging housing and a battery; the battery is detachably mounted in the charging housing; and the charging housing is provided with a charging interface and an on/off button.

As the improvement of the present disclosure, an outer wall of the charging housing is further connected to an elastic buckle; and the charging component is compressed and fixed inside the storage chamber through the elastic buckle.

As the improvement of the present disclosure, the main body is further provided with a zipper device; the zipper device is arranged on the body part; the head part is further provided with a transparent window; and the transparent window is located at one end close to the tightening device.

As the improvement of the present disclosure, the body part includes two symmetrical arm parts; the two arm parts are respectively provided with second openings convenient for the hands to extend out; the two arm parts are respectively provided with second flexible sleeves at positions close to the second openings; and second elastic bands are arranged inside the second flexible sleeves.

As the improvement of the present disclosure, the body part further includes two symmetrical leg parts; lower ends of the two leg parts are respectively provided with third openings convenient for the legs to extend out; the two leg parts are respectively provided with third flexible sleeves at positions close to the third openings; and third elastic bands are arranged in the third flexible sleeves.

As the improvement of the present disclosure, the main body and the tightening device are both made of a polyester fiber material.

The present disclosure has the following beneficial effects. The present disclosure provides an inflatable costume. The inflatable costume includes a main body, wherein the main body includes a head part and a body part; and a tightening device, wherein the tightening device is arranged between the head part and the body part. Through the above structure, when a user wears the inflatable costume, the inflatable costume can be tightened and fixed at the neck of shoulders of the user by the tightening device arranged between the head part and the body part. Furthermore, the tightening device can be adjusted according to sizes of the neck and shoulders of the user, thereby preventing the following phenomena: The inflatable costume will be loosened when the user wears it, the head part of the inflatable costume will drop, or the inflatable costume will easily move in aggravating activities, so that the inflatable costume has higher stability and applicability, and the user experience is greatly improved.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
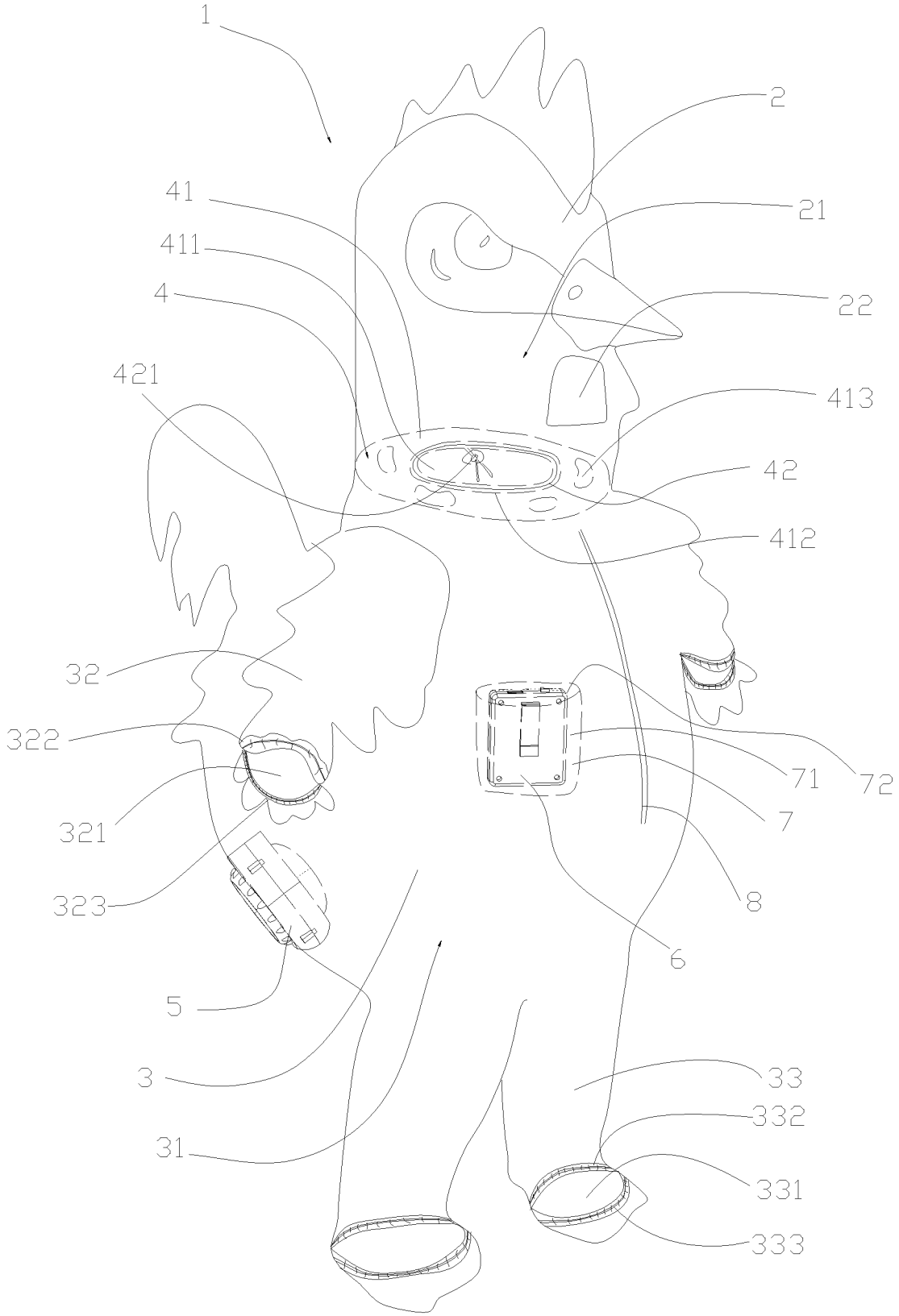
FIG. 1 is a schematic diagram of an entire structure of the present disclosure.
Figure 2:
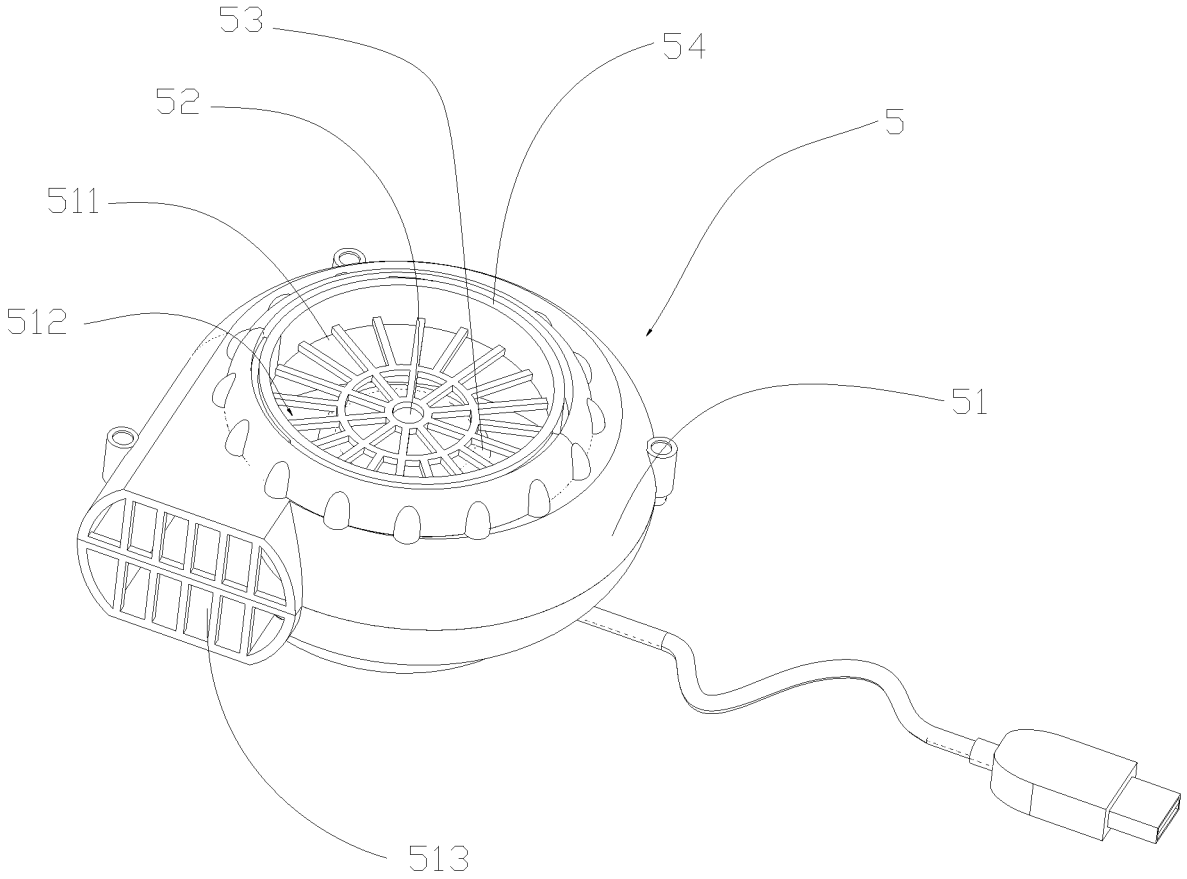
FIG. 2 is a schematic diagram of an air blasting component according to the present disclosure.
Figure 3:
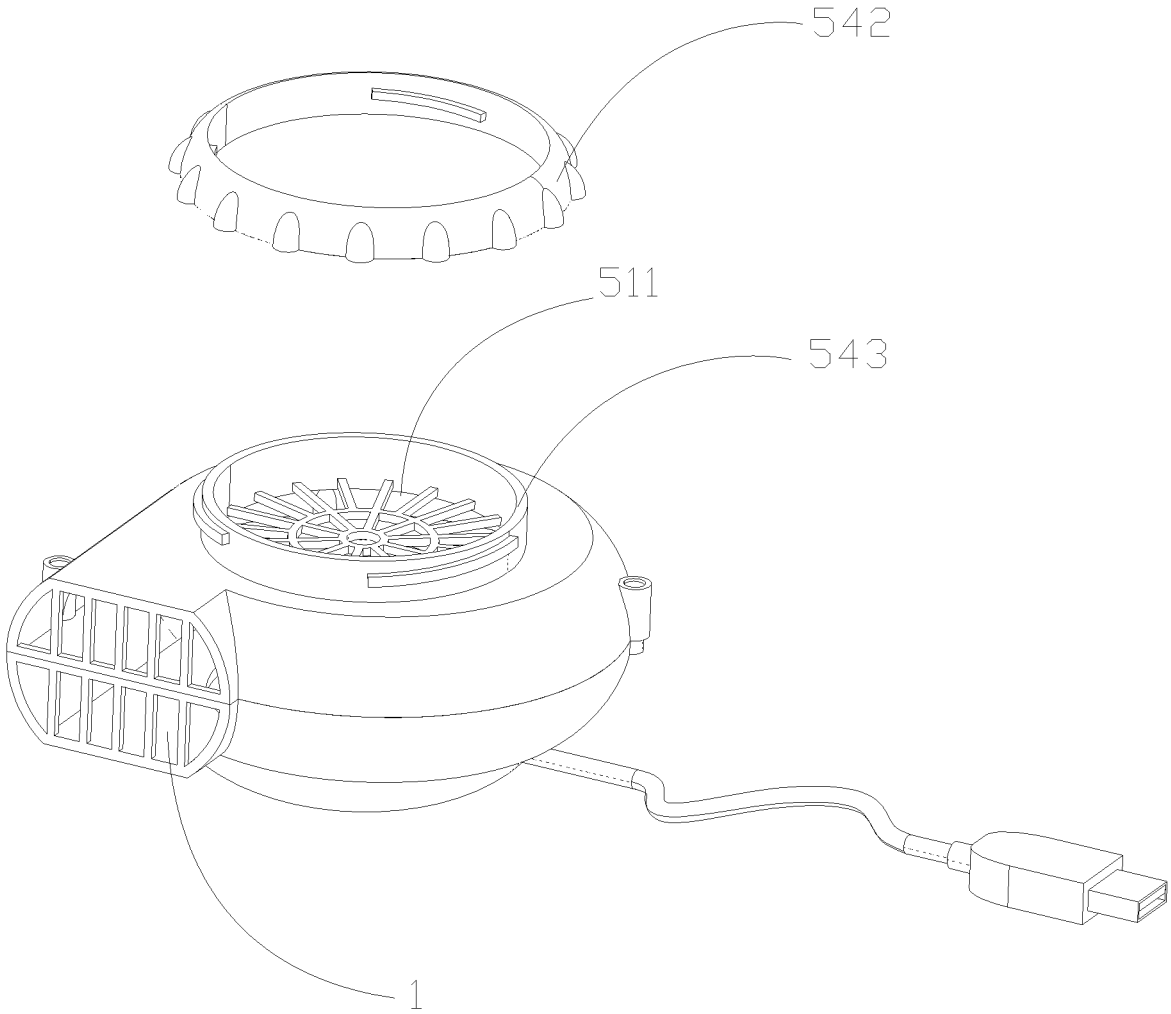
FIG. 3 is an exploded diagram of an air blasting component according to the present disclosure.
Figure 4:
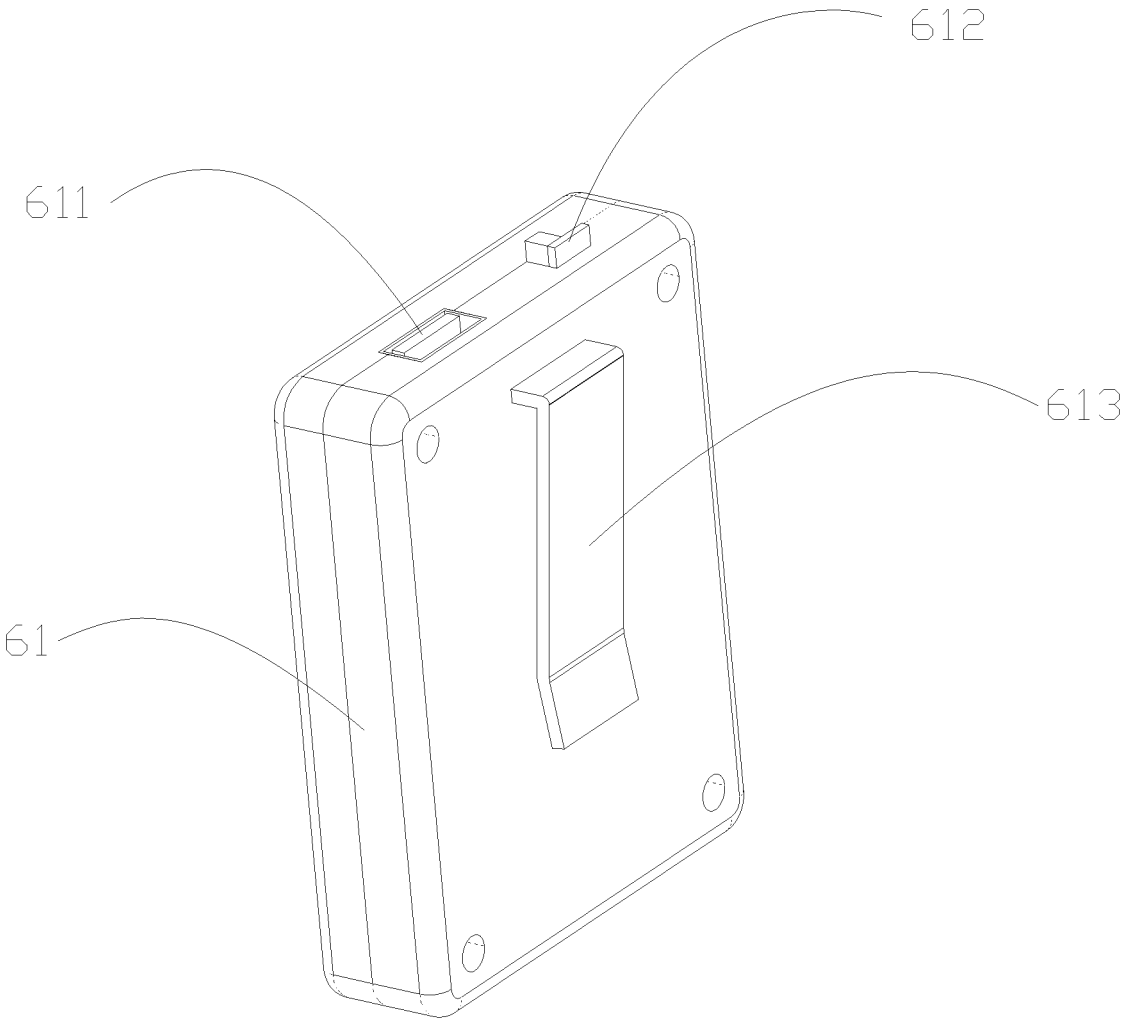
FIG. 4 is a schematic diagram of a charging component according to the present disclosure.

Referring to FIG. 1 to FIG. 5, an inflatable costume includes a main body 1, wherein the main body 1 includes a head part 2 and a body part 3; and a tightening device 4, wherein the tightening device 4 is arranged between the head part 2 and the body part 3. Through the above structure, when a user wears the inflatable costume, the inflatable costume can be tightened and fixed at the neck of shoulders of the user by the tightening device 4 arranged between the head part 2 and the body part 3. Furthermore, the tightening device 4 can be adjusted according to sizes of the neck and shoulders of the user, thereby preventing the following phenomena: The inflatable costume will be loosened when the user wears it, the head part 2 of the inflatable costume will drop, or the inflatable costume will easily move in aggravating activities, so that the inflatable costume has higher stability and applicability, and the user experience is greatly improved.

Specifically, the head part 2 has a first inflation chamber 21; the body part 3 has a second inflation chamber 31; the first inflation chamber 21 is communicated to the second inflation chamber 31; and the tightening device 4 is arranged between first inflation chamber 21 and the second inflation chamber 31. Further, the tightening device 4 includes a barrier layer 41 connected to the main body 1; the barrier layer 41 has a first opening 411; and the first inflation chamber 21, the first opening 411, and the second inflation chamber 31 are communicated to each other in sequence. Through the above structure, when the user wears the inflatable costume, the head of the user first enters the second inflation cavity 31 and then enters the first inflation cavity 21 through the first opening 411. At this time, the barrier layer 41 is approximately located at the neck and shoulders of the user.

Further, the barrier layer 41 is provided with a first elastic band 42; and the first elastic band 42 is configured to adjust a size of the first opening 411. The barrier layer 41 is provided with a first flexible sleeve 412 at a position close to the first opening 411, and the first elastic band 42 is at least partially located inside the first flexible sleeve 412. Through the above structure, the size of the first opening 411 is adjusted by adjusting the elastic band 42 located inside the first flexible sleeve 412. The barrier layer 41 is tightened at the neck of the user through the first opening 411. At this time, the size of the first opening 411 can be adjusted according to the sizes of the necks of different users, which ensures that the inflatable costume is firmer when the user wears the inflatable costume, prevents sliding or movement of the inflatable costume during activities, and provides a more stable wearing experience.

In this embodiment, an elastic strainer 421 is also arranged on the first elastic band 42; when the elastic strainer 421 is pressed, a length of the first elastic band 42 located inside the first flexible sleeve 412 can be adjusted; and when the elastic strainer 421 is released, the first elastic band 42 can be fixed to compress the first flexible sleeve 412. Through the above structure, the first elastic band 42 provided with the elastic strainer 421 allows the user to more accurately adjust the tightness of the barrier layer 41 at the neck and shoulders, so as to provide a more personalized wearing experience.

In this embodiment, the barrier layer 41 further has at least one air hole 413; and the first inflation chamber 21, the air hole 413, and the second inflation chamber 31 are communicated to each other in sequence. Further, the air hole 413 is arranged around the first opening 411. Through the above structure, when the user wears the inflatable costume and inflates the inflatable costume, since the barrier layer 41 is tied at the neck and shoulders of the user through the first elastic band 42, air will be difficultly inflated to the head part 2 blocked by the barrier layer 41. At this time, the air can be introduced to the head part 2 through the air hole 413 to prevent air being not circulated in the head part 2 and the body part 3, so that an inflation effect of the inflatable costume is effectively achieved.

In this embodiment, the inflatable costume further includes an air blasting component 5, wherein the air blasting component 5 is detachably connected to the main body 1; and the air blasting component 5 is configured to inflate the head part 2 and the body part 3 to fill the first inflation chamber 21 and the second inflation chamber 31 with air. The air blasting component 5 includes an air blasting housing 51; the air blasting housing 51 has an air inlet mesh 511, an air guide chamber 512, and an air outlet 513; the air inlet mesh 511, the air guide chamber 512, and the air outlet 513 are communicated to each other in sequence; a motor 52 and a wind wheel 53 are arranged in the air guide chamber 512; the wind wheel 53 is mounted on an output shaft of the motor 52; and the air inlet mesh 511 is coaxial with the motor 52. Through the above structure, the air blasting component 5 can inflate the main body 1 through the rotation of the motor 52 and the rotation of the wind wheel 53, which can quickly fill the inflatable costume with air and make the inflatable costume rapidly expand. This gives the inflatable costume an exaggerated and vivid appearance and can maintain the shape and predetermined appearance of the inflatable costume.

In this embodiment, the air blasting component 5 further includes a mesh pressing component 54; the mesh pressing component 54 is annularly arranged on an outer side of the air inlet mesh 511; the main body 1 is provided with a mounting port 541 adapting to be assembled with the mesh pressing component 54; and the mesh pressing component 54 is configured to assemble and connect the air blasting component 5 with the main body 1. The mesh pressing component 54 includes a rotary ring 542 for mesh pressing and a fixed ring 543; the rotary ring 542 for mesh pressing is detachably screwed onto the fixed ring 543; and the fixed ring 543 is fixedly arranged at a periphery of the air inlet mesh 511. Through the above structure, the fixed ring 543 passes through the mounting port 541, and the rotary ring 542 for mesh pressing is rotatably screwed. At this time, the air blasting component 5 can be fixed on the main body 1 and placed in the second inflation chamber 31, to play a role of the air blasting component 5. This avoids sun and rain and prolongs the service life of the air blasting component 5.

In this embodiment, the inflatable costume further includes a charging component 6, wherein the charging component 6 is electrically connected to the air blasting component 5; and the charging component 6 is configured to supply power to the air blasting component 5. The main body 1 is connected to a storage bag 7; the storage bag 7 is located in the second inflation chamber 31; the storage bag 7 has a storage chamber 71 and a storage opening 72; the storage opening 72 is communicated to the storage chamber 71; and the storage chamber 71 is configured to place the charging component 6. Specifically, the charging component 6 includes a charging housing 61 and a battery; the battery is detachably mounted in the charging housing 61; and the charging housing 61 is provided with a charging interface 611 and an on/off button 612. An outer wall of the charging housing 61 is further connected to an elastic buckle 613; and the charging component 6 can be compressed and fixed inside the storage chamber 71 through the elastic buckle 613. Through the above structure, the charging component 6 is placed in the storage bag 7 and is then electrically connected to the air blasting component 5 through a universal serial bus (USB) or another connecting wire to supply the power to the air blasting component 5, so that the charging component 6 can supply stable and continuous power to the air blasting component 5, ensuring that the inflatable costume is kept in a continuous inflation state during use. This helps the user to wear the inflatable costume for a long time. Especially when the user participates in various activities or celebrations, the comfort of the user and the convenience of use are improved. Due to the elastic buckle 613, the charging component 6 is placed in the inflatable costume more securely and will not fall off due to big movements.

In this embodiment, the main body 1 is further provided with a zipper device 8; the zipper device 8 is arranged on the body part 3; the head part 2 is further provided with a transparent window 22; and the transparent window 22 is located at one end close to the tightening device 4. Through the above structure, the zipper device 8 facilitates the user to easily put on or take off the inflatable costume. The head part 2 has an opening, and a transparent plastic sheet is sewn at the opening to form the transparent window 22. The transparent window 22 allows the user to observe the outside when the user does activities in the inflatable costume. It is convenient for the user to walk around when wearing the inflatable costume, and accidental fall caused by blocking of a sight line is prevented.

In this embodiment, the body part 3 includes two symmetrical arm parts 32; the two arm parts 32 are respectively provided with second openings 321 convenient for the hands to extend out; the two arm parts 32 are respectively provided with second flexible sleeves 322 at positions close to the second openings 321; and second elastic bands 323 are arranged inside the second flexible sleeves 322. Through the above structure, due to the arrangement of the second openings 321 on the two arm parts 32, the hands can be exposed when the user wears the inflatable costume. This helps the user to perform various operations more easily, such as picking up objects and playing games. This makes the inflatable costume more practical in various situations. Moreover, due to the arrangement of the second elastic bands 323, sliding or displacement of the inflatable costume in activities is prevented, which helps to maintain the overall appearance and comfort of the inflatable costume.

In this embodiment, the body part 3 further includes two symmetrical leg parts 33; lower ends of the two leg parts 33 are respectively provided with third openings 331 convenient for the legs to extend out; the two leg parts 33 are respectively provided with third flexible sleeves 332 at positions close to the third openings 331; and third elastic bands 333 are arranged in the third flexible sleeves 332. Through the above structure, the feet are allowed to be exposed, so that the user can select different types of shoes to match the inflatable costume, which further personalizes the overall design, provides the user with more choices, and increases the fun and flexibility of the inflatable costume. Moreover, due to the arrangement of the third elastic bands 333, sliding or displacement of the inflatable costume in activities is prevented, which helps to maintain the overall appearance and comfort of the inflatable costume.

In this embodiment, the main body 1 and the tightening device 4 are both made of a polyester fiber material. Through the above structure, a polyester fiber is a soft lightweight material that effectively achieves the deformation of the tightening device 4, thus achieving a tightening function. Furthermore, the inflatable costume is lighter and makes a wearer feel more comfortable. The polyester fiber usually has high wear resistance, which helps to prolong the service life of the inflatable costume.

The accompanying drawings in the embodiment of the present disclosure are combined, The technical scheme in the embodiment of the present disclosure is clearly and completely described, Obviously, the described embodiment is only a part of the embodiment of the present disclosure, but not all embodiments are based on the embodiment of the present disclosure, and all other embodiments obtained by ordinary technicians in the field on the premise of not doing creative work belong to the protection range of the present disclosure.

What is claimed is:

1. An inflatable costume, comprising:

a main body, wherein the main body comprises a head part and a body part; the head part has a first inflation chamber, and the body part has a second inflation chamber; and a tightening device, wherein the tightening device is arranged between the first inflation chamber of the head part and the second inflation chamber of the body part and configured to fix the inflatable costume at a neck and shoulders of a user, and the first inflation chamber is communicated to the second inflation chamber through a first opening defined in the tightening device;

wherein the tightening device comprises a barrier layer connected to the main body; the first opening is defined in the barrier layer; and the first opening is configured to sleeve around the neck of the user to position the barrier layer at the neck and the shoulders of the user;

wherein the barrier layer is provided with a first elastic band; and the first elastic band is configured to adjust a size of the first opening.

2. The inflatable costume according to claim 1, wherein the barrier layer is provided with a first flexible sleeve positioned around the first opening, and the first elastic band is at least partially located inside the first flexible sleeve.

3. The inflatable costume according to claim 2, wherein an elastic strainer is also arranged on the first elastic band; when the elastic strainer is pressed, a length of the first elastic band located inside the first flexible sleeve is adjusted; and when the elastic strainer is released, the first elastic band is fixed to compress the first flexible sleeve.

4. The inflatable costume according to claim 1, wherein the barrier layer further has at least one air hole independent from the first opening; and the first inflation chamber, the air hole, and the second inflation chamber are communicated to each other in sequence.

5. The inflatable costume according to claim 4, wherein the barrier layer defines a plurality of air holes, and the plurality of air holes are arranged around the first opening.

6. The inflatable costume according to claim 1, further comprising an air blasting component, wherein the air blasting component is detachably connected to the main body; and the air blasting component is configured to inflate the head part and the body part to fill the first inflation chamber and the second inflation chamber with air.

7. The inflatable costume according to claim 6, wherein the air blasting component comprises an air blasting housing; the air blasting housing has an air inlet mesh, an air guide chamber, and an air outlet; the air inlet mesh, the air guide chamber, and the air outlet are communicated to each other in sequence; a motor and a wind wheel are arranged in the air guide chamber; the wind wheel is mounted on an output shaft of the motor; and the air inlet mesh is coaxial with the motor.

8. The inflatable costume according to claim 7, wherein the air blasting component further comprises a mesh pressing component; the mesh pressing component is annularly arranged on an outer side of the air inlet mesh; the main body is provided with a mounting port adapting to be assembled with the mesh pressing component; and the mesh pressing component is configured to assemble and connect the air blasting component with the main body.

9. The inflatable costume according to claim 8, wherein the mesh pressing component comprises a rotary ring for mesh pressing and a fixed ring; the rotary ring for mesh pressing is detachably screwed onto the fixed ring; and the fixed ring is fixedly arranged at a periphery of the air inlet mesh.

10. The inflatable costume according to claim 6, further comprising a charging component, wherein the charging component is electrically connected to the air blasting component; and the charging component is configured to supply power to the air blasting component.

11. The inflatable costume according to claim 1, wherein the main body is further provided with a zipper device; the zipper device is arranged on the body part; the head part is further provided with a transparent window; and the transparent window is located at one end close to the tightening device.

12. The inflatable costume according to claim 1, wherein the body part comprises two symmetrical arm parts; the two arm parts are respectively provided with second openings convenient for the hands to extend out; the two arm parts are respectively provided with second flexible sleeves at positions proximate to the second openings; and second elastic bands are arranged inside the second flexible sleeves.

13. The inflatable costume according to claim 1, wherein the body part further comprises two symmetrical leg parts; lower ends of the two leg parts are respectively provided with third openings convenient for the legs to extend out; the two leg parts are respectively provided with third flexible sleeves at positions proximate to the third openings; and third elastic bands are arranged in the third flexible sleeves.

14. The inflatable costume according to claim 1, wherein the main body and the tightening device are both made of a polyester fiber material.

15. An inflatable costume, comprising:

a main body, wherein the main body comprises a head part and a body part; the head part has a first inflation chamber, and the body part has a second inflation chamber; and a tightening device, wherein the tightening device is arranged between the first inflation chamber of the head part and the second inflation chamber of the body part and configured to fix the inflatable costume at a neck and shoulders of a user, and the first inflation chamber is communicated to the second inflation chamber through a first opening defined in the tightening device;

an air blasting component, wherein the air blasting component is detachably connected to the main body; and the air blasting component is configured to inflate the head part and the body part to fill the first inflation chamber and the second inflation chamber with air; and a charging component, wherein the charging component is electrically connected to the air blasting component; and the charging component is configured to supply power to the air blasting component;

wherein the main body is connected to a storage bag; the storage bag is located in the second inflation chamber; the storage bag has a storage chamber and a storage opening; the storage opening is communicated to the storage chamber; and the storage chamber is configured to place the charging component.

16. The inflatable costume according to claim 15, wherein the charging component comprises a charging housing and a battery; the battery is detachably mounted in the charging housing; and the charging housing is provided with a charging interface and an on/off button.

17. The inflatable costume according to claim 16, wherein an outer wall of the charging housing is further connected to an elastic buckle; and the charging component is compressed and fixed inside the storage chamber through the elastic buckle.

18. An inflatable costume, comprising:

a main body, wherein the main body comprises a head part and a body part; the head part has a first inflation chamber, and the body part has a second inflation chamber; and a tightening device, wherein the tightening device is arranged between the first inflation chamber of the head part and the second inflation chamber of the body part and configured to fix the inflatable costume at a neck and shoulders of a user, and the first inflation chamber is communicated to the second inflation chamber through a first opening defined in the tightening device;

an air blasting component, wherein the air blasting component is detachably connected to the main body; and the air blasting component is configured to inflate the head part and the body part to fill the first inflation chamber and the second inflation chamber with air; and a charging component, wherein the charging component is electrically connected to the air blasting component; and the charging component is configured to supply power to the air blasting component;

wherein the inflatable costume is shaped like a chicken, the charging component is arranged at the chest or abdomen of the chicken and the air blasting component is arranged at the buttocks of the chicken.

* * * * *